US008307776B2

(12) United States Patent
Brooks

(10) Patent No.: US 8,307,776 B2
(45) Date of Patent: Nov. 13, 2012

(54) SMART BOOKMARK

(76) Inventor: Andre L. Brooks, San Jose, CA (US)

( * ) Notice: Subject to any disclaimer, the term of this patent is extended or adjusted under 35 U.S.C. 154(b) by 222 days.

(21) Appl. No.: 11/924,472

(22) Filed: Oct. 25, 2007

(65) Prior Publication Data

US 2009/0107392 A1 Apr. 30, 2009

(51) Int. Cl.
*B42D 9/00* (2006.01)

(52) U.S. Cl. ..... 116/235

(58) Field of Classification Search ..... 116/234–240; 281/42

See application file for complete search history.

(56) References Cited

U.S. PATENT DOCUMENTS

| | | | | |
|---|---|---|---|---|
| 2,543,182 | A | 2/1951 | Lang | |
| 2,964,010 | A * | 12/1960 | Harrison | 116/234 |
| 4,680,210 | A | 7/1987 | Corcoran | |
| 4,838,198 | A | 6/1989 | Knox | |
| 4,898,115 | A | 2/1990 | Bowlay-Williams | |
| 5,022,342 | A | 6/1991 | Davis | |
| 5,408,950 | A * | 4/1995 | Porto | 116/239 |
| 5,462,007 | A | 10/1995 | Prescott | |
| 5,515,809 | A | 5/1996 | Weinberg | |
| 6,205,947 | B1 | 3/2001 | Drew | |
| 6,298,804 | B1 | 10/2001 | Kamen | |
| 6,550,417 | B2 | 4/2003 | Hendershot | |
| D495,739 | S | 9/2004 | Boyce, Jr. et al. | |
| D495,740 | S | 9/2004 | Lee | |
| 6,948,447 | B1 | 9/2005 | Yingling | |
| 7,004,106 | B1 | 2/2006 | Forance | |
| 7,055,861 | B1 | 6/2006 | Lee | |
| 7,059,637 | B2 * | 6/2006 | Stewart et al. | 281/42 |

FOREIGN PATENT DOCUMENTS

| | | | |
|---|---|---|---|
| JP | 57070868 | U * | 4/1982 |
| JP | 07329448 | A * | 12/1995 |
| JP | 2007245692 | A * | 9/2007 |
| KR | 2003012334 | A * | 2/2003 |
| KR | 2003091091 | A * | 12/2003 |
| WO | WO 8102867 | A1 * | 10/1981 |
| WO | WO 2004009370 | A1 * | 1/2004 |

OTHER PUBLICATIONS

PTO 10-3627 translation of JP 07-329448 A, Yokoyama, Dec. 19, 1995, USPTO, STIC Library.*
PTO 10-4254 translation of WO 8102867 A1, Furukawa, Oct. 15, 1981, USPTO, STIC Library.*
PCT International Search Report dated Dec. 29, 2008.

* cited by examiner

*Primary Examiner* — R. A. Smith
(74) *Attorney, Agent, or Firm* — Koestner Patent Law; Ken J. Koestner

(57) ABSTRACT

A position-identifying bookmark for identifying a reader's position on a page comprises at least one string, and first and second sheets. The first sheet has first and second planar sides, re-adherable adhesive on at least a portion of one of the first and second planar sides, and an aperture passing through the first sheet for connecting to the at least one string. The second sheet has first and second planar sides, re-adherable adhesive on at least a portion of one of the first and second planar sides, and an aperture passing through the second sheet for connecting to the at least one string.

20 Claims, 4 Drawing Sheets

SMART BOOKMARK

BACKGROUND

A bookmark is used to mark the page at which a reader's reading is interrupted by placement between pages, thereby identifying the position of interruption within a range of the two pages. Efficiency is promoted by more precisely locating the position of interruption.

SUMMARY

An embodiment of a position-identifying bookmark for identifying a reader's position on a page comprises at least one string, and first and second sheets. The first sheet has first and second planar sides, re-adherable adhesive on at least a portion of one of the first and second planar sides, and an aperture passing through the first sheet for connecting to the at least one string. The second sheet has first and second planar sides, re-adherable adhesive on at least a portion of one of the first and second planar sides, and an aperture passing through the second sheet for connecting to the at least one string.

BRIEF DESCRIPTION OF THE DRAWINGS

Embodiments of the invention relating to both structure and method of operation may best be understood by referring to the following description and accompanying drawings.

DETAILED DESCRIPTION

Various embodiments of a bookmark depicted herein can identify the exact location in a book, magazine, or newspaper at which the reader can continue reading when ready.

Figure 1B:
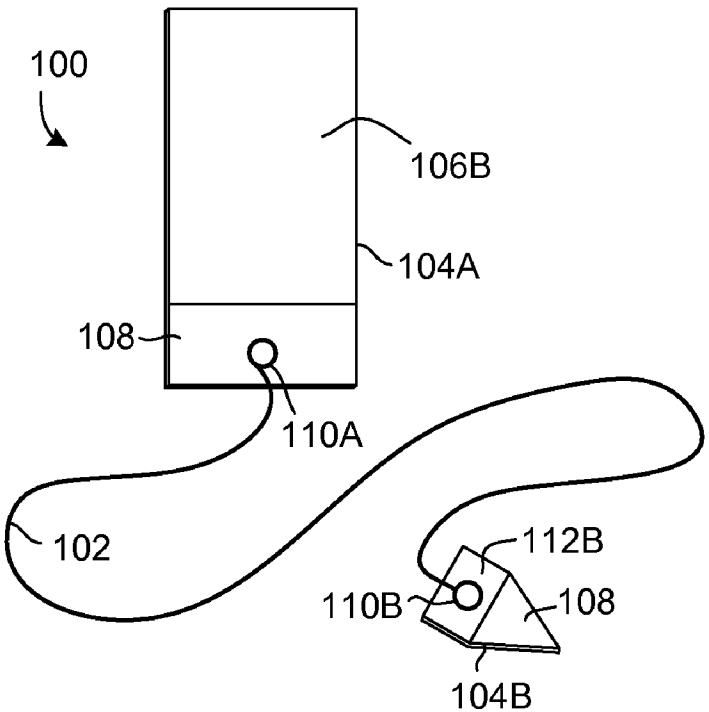
FIGS. 1A and 1B are respective planar pictorial front and back views depicting an embodiment of bookmark enabling a reader to identify a position of interest on a page.
Figure 1A:
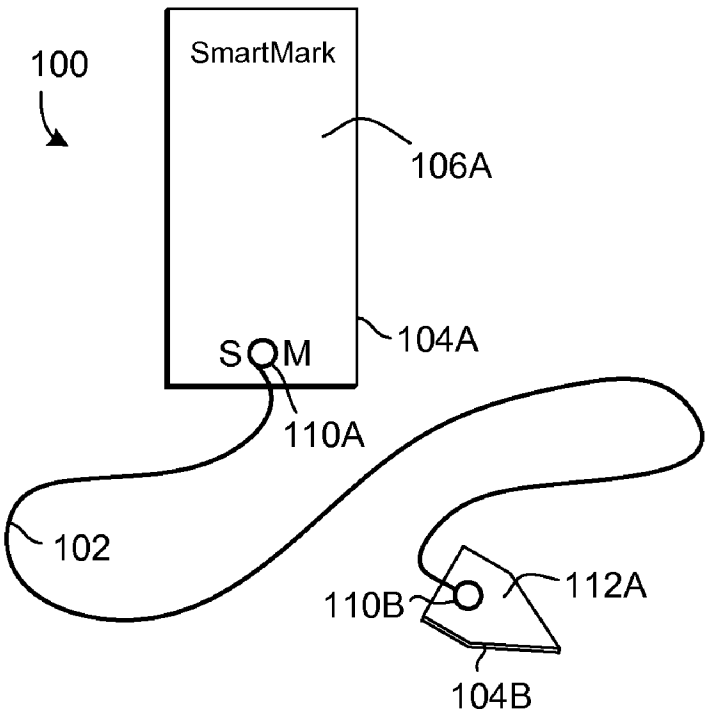

Referring to FIGS. 1A and 1B, respective planar pictorial front and back views show an embodiment of bookmark 100 enabling a reader to identify a position of interest on a page. The illustrative bookmark 100 comprises a page marker member 104A formed of a planar sheet with first 106A and second 106B sides and re-adherable adhesive 108 on a portion of one of the first 106A and second 106B planar sides. The bookmark 100 further comprises a page position marker member 104B formed of a planar sheet with first 112A and second 112B sides and re-adherable adhesive 108 on a portion of the one of the first 112A and second 112B planar sides. A string 102 is connected between the page marker member 104A and the page position marker member 104B.

The page marker member 104A can comprise a rectangular planar sheet of paper, such as stationery, and a re-adherable strip of adhesive 108 coupled to one of the page marker member first 106A and second 106B planar sides that temporarily attaches the page marker member to a book page.

The page position marker member 104B can comprise an arrow-shaped planar sheet of paper or stationery, and a re-adherable strip of adhesive 108 coupled to one of the page position marker member first 112A and second 112B planar sides that temporarily attaches the page position marker member 104B to a book page.

The illustrative page marker member 104A is perforated by a first hole 110A and the page position marker member 104B perforated by a second hole 110B. The string 102 is attached between the first hole 110A and the second hole 110B.

The re-adherable adhesive 108 on the page marker member 104A and the page position marker member 104B can be formed of a low-tack adhesive that enables attachment and removal from a book page without leaving marks or residue.

In an example embodiment, an improved bookmark can be formed from a sheet of paper or stationary with a strip of low-tack adhesive such as a Post-it™ note, manufactured by 3M Company of Saint Paul, Minn., which is used as a marker, and a second sheet that can be smaller and further can be shaped as an arrow for usage as a pointer and also having the adhesive. The marker can mark a particular page in a book and the pointer marking the exact location where a reader has stopped reading. To maintain a connection between the marker and the pointer, holes can perforate each sheet for attachment using a string or cord.

Figure 2B:
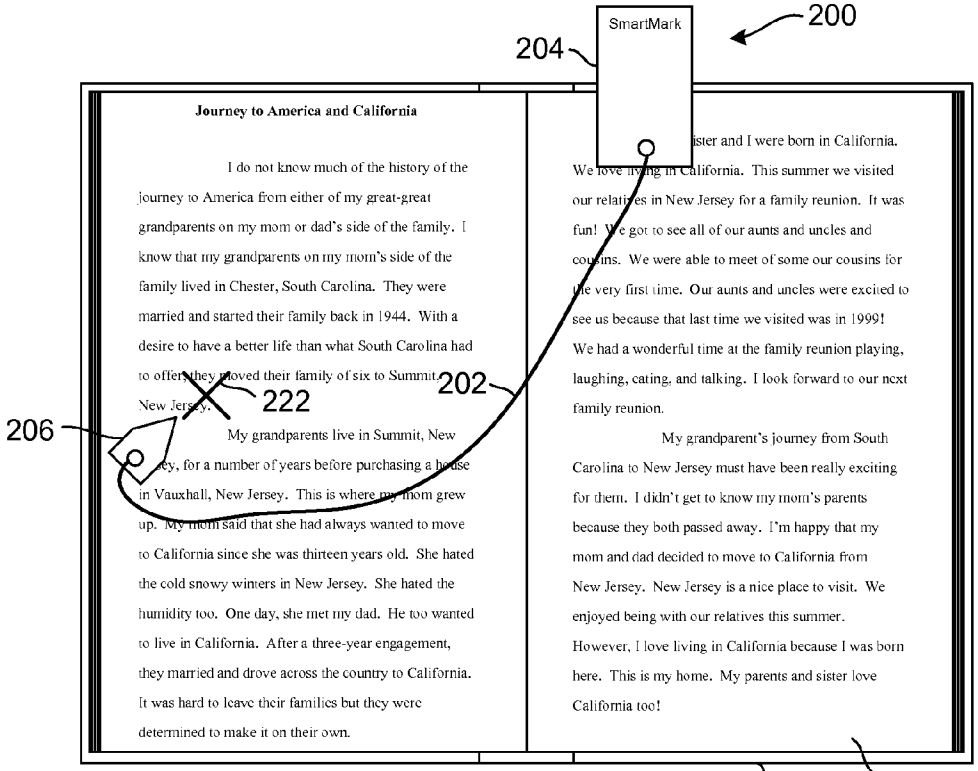
FIGS. 2A and 2B are pictorial views illustrating an example usage of an embodiment of a SmartMark bookmark for marking a page and indicating a position on a page of a book.
Figure 2A:
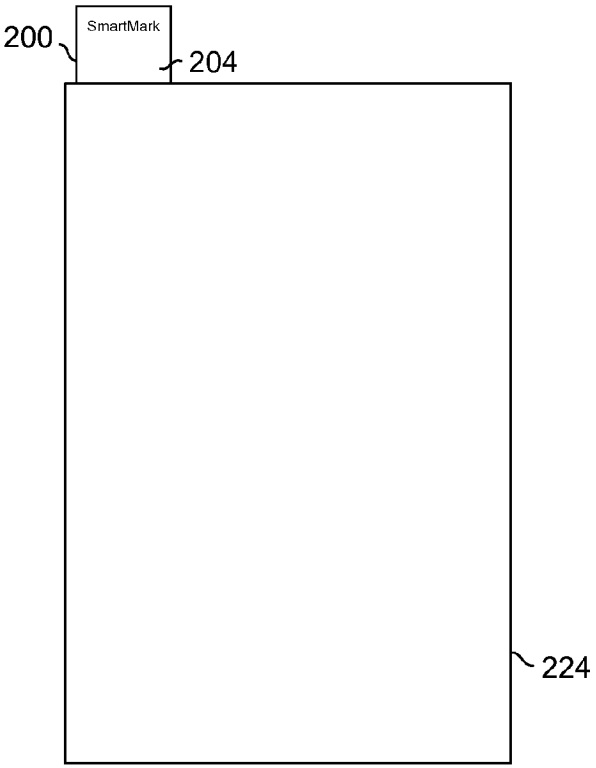

Referring to FIGS. 2A and 2B, pictorial views show an example usage of an embodiment of a SmartMark bookmark 200 in usage for marking a page 220 and indicating a position 222 on a page of a book 224. The illustrative SmartMark bookmark 200 is a paper marker with an adhesive backing on a bookmark portion 204 with a string 202 attached to an arrow 206 which is used to quickly identify the place 222 where the reader stopped reading. The adhesive backing on the bookmark portion 204 is safely placed on the page 220 so that if the book should fall or is dropped the bookmark 200 will not fall out of the book, magazine, or newspaper thus losing the reader's page location 222. The string 202 attaches to the bookmark portion 204 and the arrow 206 which is used to identify the reader's exact word, words, or paragraph location on the page where reading last ended, solving the problem of rereading pages or paragraphs because the average bookmark only allows the reader to place the bookmark between pages but does not assist the reader in recalling the exact location of where the reader left off reading. The bookmark portion 204 of the SmartMark 200 can be placed on the exact page where reading ended. The SmartMark 200 can be used as long as desired while reading because of the easily removable adhesive backing.

The SmartMark 200 assists reading for all ages, professions, workers, coworkers, teachers, parents, students, business owners, and children because using the SmartMark 200 saves valuable time by easily enabling the reader to locate the exact position on a page where reading ended in a book, magazine, or newspaper. The SmartMark 200 is easy to use because of the adhesive backing on the bookmark portion 204 and the adhesive backing on the arrow locator 206.

The SmartMark 200 takes bookmarking a step further by allowing the reader to mark the exact page or area of reading by placing an arrow on the word or paragraph where reading ended. The bookmark 200 is easy to use because the adhesive backing enables the reader to place and temporarily adhere the bookmark 200 directly on the page rather than held loosely between pages. The bookmark 200 is prevented from falling out of a book, magazine, or newspaper and can be reapplied to another page as reading continues.

Figure 3:
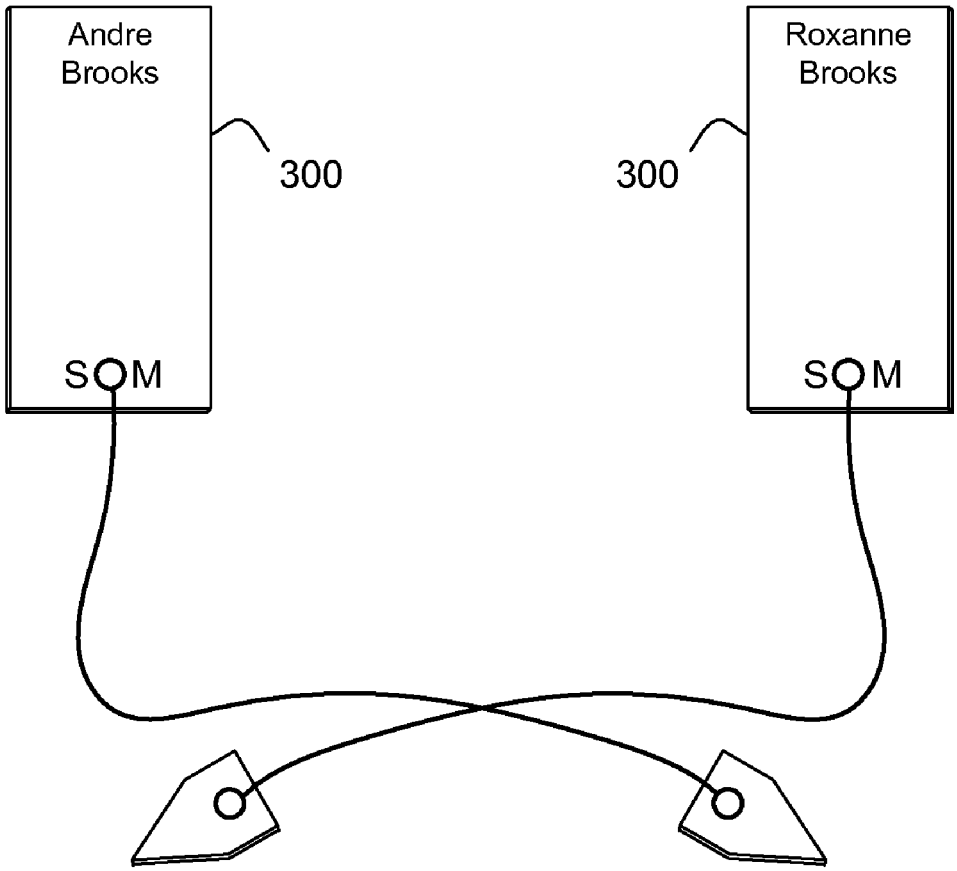
FIG. 3 is a pictorial view showing an example of personalized SmartMark bookmarks.

Referring to FIG. 3, a pictorial view shows an example of personalized SmartMark bookmarks 300.

Figure 4B:
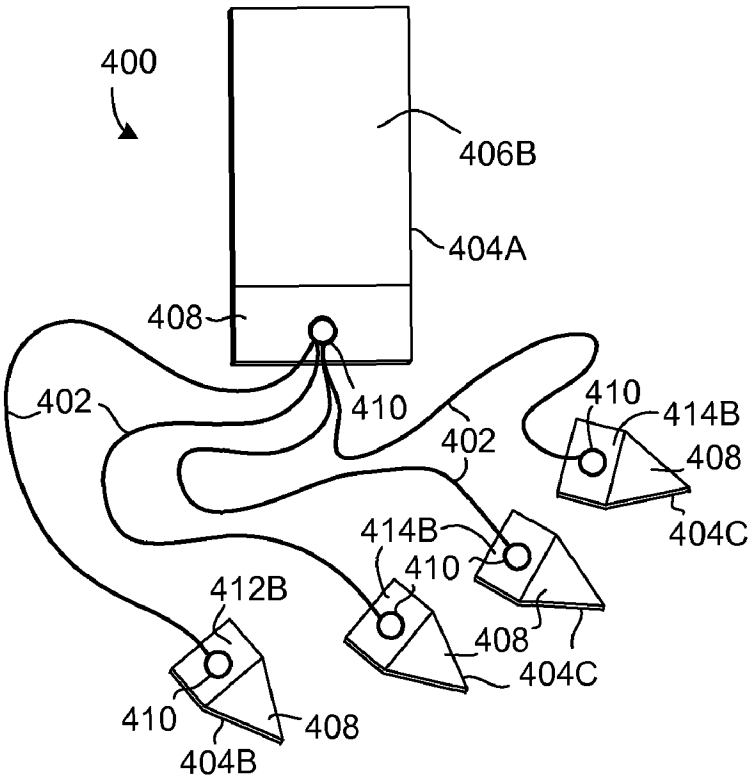
FIGS. 4A and 4B, respective planar pictorial front and back views show an embodiment of a position-identifying bookmark that enables a reader to identify a position of interest on a page.
Figure 4A:
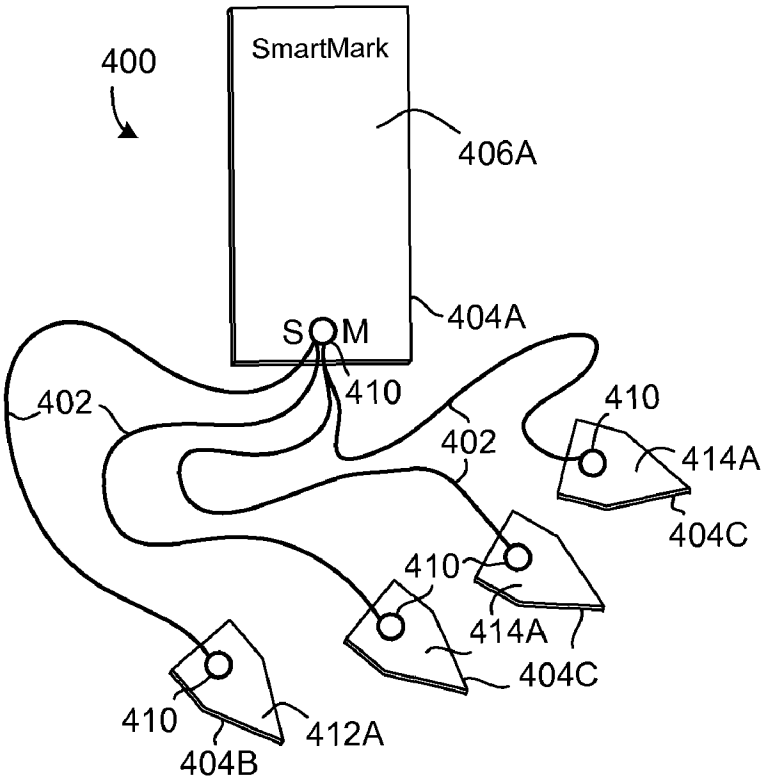

Referring to FIGS. 4A and 4B, respective planar pictorial front and back views show an embodiment of a position-identifying bookmark 400 that enables a reader to identify a position of interest on a page. The bookmark 400 comprises at least one string 402, and first 404A and second 404B sheets. The first sheet 404A has first 406A and second 406B planar sides, re-adherable adhesive 408 on at least a portion of one of the first 406A and second 406B planar sides, and an aperture 410 passing through the first sheet 404A for connecting to the string or strings 402. The second sheet 404B has first 412A and second 412B planar sides, re-adherable adhesive 408 on at least a portion of one of the first 412A and second 412B planar sides, and an aperture 410 passing through the second sheet 404B for connecting to the string or strings 402.

In some configurations, the bookmark 400 can further comprise one or more sheets 404C in addition to the first 404A and second 404B sheets, each sheet 404C having first 414A and second 414B planar sides, re-adherable adhesive 408 on at least a portion of one of the first 414A and second 414B planar sides, and an aperture 410 passing through the one or more sheets 404C for connecting to the strings 402.

The first sheet 404A is typically used to identify a page in a book and the second sheet 404B used as a pointer for identifying a position on a page in the book.

In an illustrative embodiment, the first sheet 404A can comprise a rectangular planar sheet of paper, for example stationery, and a re-adherable strip of adhesive 408 coupled to one of the first sheet first 406A and second 406B planar sides that temporarily attaches the first sheet 404A to a book page. Similarly, the second sheet 404B can comprise a pointer-shaped planar sheet of paper or stationery, and a re-adherable strip of adhesive 408 coupled to one of the second sheet first 412A and second 412B planar sides that temporarily attaches the second sheet to a page.

The string 402 can be attached between the aperture 410 in the first sheet 404A and the aperture 410 in the second sheet 404B.

In a typical application, the re-adherable adhesive 408 on the first 404A and second 404B sheets are formed of a low-tack adhesive that enables attachment and removal from a book page without leaving marks or residue.

In an illustrative embodiment, the position-identifying bookmark 400 can be constructed by a method comprising providing a first sheet 404A with first 404A and second 404B planar sides, applying a re-adherable adhesive 408 on at least a portion of one of the first 406A and second 406B planar sides of the first sheet 404A, and forming an aperture 410 that passes through the first sheet 404A. Similarly, a second sheet 404B with first 412A and second 412B planar sides can be provided with the re-adherable adhesive 408 applied on at least a portion of one of the first 412A and second 412B planar sides of the second sheet 404B. An aperture 410 can be formed that passes through the second sheet 404B. The method further comprises passing a string 402 through the aperture 410 in the first sheet 404A and the aperture 410 in the second sheet 404B, thereby coupling the second sheet 404B to the first sheet 404A. The bookmark 400 enables a reader to identify a position of interest on a book page.

The illustrative method describes a technique for constructing or manufacturing a bookmark 400 with a single position pointer. A multiple-pointer configuration can be constructed by providing one or more sheets 404C in addition to the first 404A and second 404B sheets, each sheet 404C having first 414A and second 414B planar sides, applying the re-adherable adhesive 408 on at least a portion of one of the first 414A and second 414B planar sides of the one or more sheets 404C, and forming apertures 410 passing through the one or more sheets 404C. Strings 402 are passed through the aperture 410 on the first sheet 404A and the apertures for the one or more additional sheets 404C, thereby coupling the one or more additional sheets 404C to the first sheet 404A.

The re-adherable adhesive 408 can be formed on the first, second, and additional sheets 404(A,B,C) using a low-tack adhesive that enables attachment and removal from a book page without leaving marks or residue.

Typically, the first sheet 404A is configured for identifying a page in a book and the second sheet 404B configured as a pointer for identifying a position on a page in the book.

Terms "substantially", "essentially", or "approximately", that may be used herein, relate to an industry-accepted tolerance to the corresponding term. Such an industry-accepted tolerance ranges from less than one percent to twenty percent and corresponds to, but is not limited to, functionality, values, process variations, sizes, operating speeds, and the like. The term "coupled", as may be used herein, includes direct coupling and indirect coupling via another component, element, circuit, or module where, for indirect coupling, the intervening component, element, circuit, or module does not modify the information of a signal but may adjust its current level, voltage level, and/or power level. Inferred coupling, for example where one element is coupled to another element by inference, includes direct and indirect coupling between two elements in the same manner as "coupled".

While the present disclosure describes various embodiments, these embodiments are to be understood as illustrative and do not limit the claim scope. Many variations, modifications, additions and improvements of the described embodiments are possible. For example, those having ordinary skill in the art will readily implement the steps necessary to provide the structures and methods disclosed herein, and will understand that the process parameters, materials, and dimensions are given by way of example only. The parameters, materials, and dimensions can be varied to achieve the desired structure as well as modifications, which are within the scope of the claims. Variations and modifications of the embodiments disclosed herein may also be made while remaining within the scope of the following claims.

What is claimed is:

1. A bookmark comprising:

a page marker member formed of a planar sheet with first and second sides and re-adherable adhesive on a portion of one of the first and second planar sides that inserts between pages of a book and is temporarily adhered to a page of the book;

a page position marker member formed of a planar sheet with first and second sides and re-adherable adhesive on a portion of the one of the first and second planar sides that is temporarily adhered to a page of the book at a selected position; and a string extending a selected length from a first end to a second end coupled between and connecting the page marker member on the first end and the page position marker member on the second end, the selected length of the string configured for spatial separation of the page marker member and the page position marker on one or more pages.

2. The bookmark according to claim 1 further comprising:

the page marker member comprising:

the planar sheet comprising a rectangular planar sheet of stationery; and the re-adherable adhesive comprising a re-adherable strip of adhesive coupled to one of the page marker member first and second planar sides that temporarily attaches the page marker member to a book page.

3. The bookmark according to claim 1 further comprising:
the page position marker member comprising:
the planar sheet comprising an arrow-shaped planar sheet of stationery; and
the re-adherable adhesive comprising a re-adherable strip of adhesive coupled to one of the page position marker member first and second planar sides that temporarily attaches the page position marker member to a book page.

4. The bookmark according to claim 1 further comprising:
the page marker member perforated by a first hole;
the page position marker member perforated by a second hole; and
the string first end attached to the first hole and the string second end attached to the second hole.

5. The bookmark according to claim 1 further comprising:
the re-adherable adhesive on the page marker member and the page position marker member are formed of a low-tack adhesive that enables attachment and removal from a book page without leaving marks or residue.

6. The bookmark according to claim 1 further comprising:
the page marker member comprising:
the planar sheet comprising a rectangular planar sheet of paper; and
the re-adherable adhesive comprising a re-adherable strip of adhesive coupled to one of the page marker member first and second planar sides that temporarily attaches the page marker member to a book page.

7. The bookmark according to claim 1 further comprising:
the page position marker member comprising:
the planar sheet comprising an arrow-shaped planar sheet of paper; and
the re-adherable adhesive comprising a re-adherable strip of adhesive coupled to one of the page position marker member first and second planar sides that temporarily attaches the page position marker member to a book page.

8. A position-identifying bookmark for identifying a reader's position on a page comprising:
at least one string extending a selected length from a first end to a second end;
a first sheet with first and second planar sides, re-adherable adhesive on at least a portion of one of the first and second planar sides, and an aperture passing through the first sheet for connecting to the at least one string, the first sheet that inserts between pages of a book and is temporarily adhered to a page of the book; and
a second sheet with first and second planar sides, re-adherable adhesive on at least a portion of one of the first and second planar sides, and an aperture passing through the second sheet for connecting to the at least one string, the second sheet that is temporarily adhered to a page of the book at a selected position;
the at least one string extending between and connecting the first sheet on the first end and the second sheet on the second end, the selected length of the string configured for spatial separation of the first sheet and the second sheet on one or more pages.

9. The bookmark according to claim 8 further comprising:
one or more sheets in addition to the first and second sheets, each with first and second planar sides, re-adherable adhesive on at least a portion of one of the first and second planar sides, and an aperture passing through the one or more sheets for connecting to ones of the at least one string, the one or more sheets configured for temporarily adhering to a page of the book at a selected position.

10. The bookmark according to claim 8 further comprising:
the first sheet configured for identifying a page in a book; and
the second sheet configured as a pointer for identifying a position on a page in the book.

11. The bookmark according to claim 8 further comprising:
the first sheet comprising:
the planar sheet comprising a rectangular planar sheet of stationery; and
the re-adherable adhesive comprising a re-adherable strip of adhesive coupled to one of the first sheet first and second planar sides that temporarily attaches the first sheet to a book page.

12. The bookmark according to claim 8 further comprising:
the second sheet comprising:
the planar sheet comprising a pointer-shaped planar sheet of stationery; and
the re-adherable adhesive comprising a re-adherable strip of adhesive coupled to one of the second sheet first and second planar sides that temporarily attaches the second sheet to a page.

13. The bookmark according to claim 8 further comprising:
the string first end attached to the first sheet aperture and the string second end attached to the second sheet aperture.

14. The bookmark according to claim 8 further comprising:
the re-adherable adhesive on the first and second sheets are formed of a low-tack adhesive that enables attachment and removal from a book page without leaving marks or residue.

15. The bookmark according to claim 8 further comprising:
the first sheet comprising:
the planar sheet comprising a rectangular planar sheet of paper; and
the re-adherable adhesive comprising a re-adherable strip of adhesive coupled to one of the first sheet first and second planar sides that temporarily attaches the first sheet to a book page.

16. The bookmark according to claim 8 further comprising:
the second sheet comprising:
the planar sheet comprising a pointer-shaped planar sheet of paper; and
the re-adherable adhesive comprising a re-adherable strip of adhesive coupled to one of the second sheet first and second planar sides that temporarily attaches the second sheet to a page.

17. A method for constructing a position-identifying bookmark for identifying a reader's position on a page comprising:
providing a first sheet with first and second planar sides;
applying a re-adherable adhesive on at least a portion of one of the first and second planar sides of the first sheet wherein the first sheet inserts between pages of a book and is temporarily adhered to a page of the book;
forming an aperture passing through the first sheet;
providing a second sheet with first and second planar sides;
applying the re-adherable adhesive on at least a portion of one of the first and second planar sides of the second sheet wherein the second sheet is temporarily adhered to a page of the book at a selected position;
forming and an aperture passing through the second sheet;
providing a string extending a selected length from a first end to a second end;
configuring the selected length of the string for spatial separation of the first sheet and the second sheet on one or more pages; and passing the string through the first sheet aperture and the second sheet aperture, the string extending between and coupling the second sheet to the first sheet.

18. The method according to claim 17 further comprising:

providing one or more sheets in addition to the first and second sheets, each with first and second planar sides;

applying the re-adherable adhesive on at least a portion of one of the first and second planar sides of the one or more sheets wherein the one or more sheets insert between pages of a book and is temporarily adhered to a page of the book;

forming apertures passing through the one or more sheets; and passing strings through the first sheet aperture and the one or more additional sheet aperture, coupling the one or more additional sheets to the first sheet.

19. The method according to claim 17 further comprising:

forming the re-adherable adhesive on the first and second sheets of a low-tack adhesive that enables attachment and removal from a book page without leaving marks or residue.

20. The method according to claim 17 further comprising:

configuring the first sheet for identifying a page in a book; and configuring the second sheet as a pointer for identifying a position on a page in the book.

* * * * *